United States Patent [19]

Flecknoe-Brown

[11] Patent Number: 4,639,165

[45] Date of Patent: Jan. 27, 1986

[54] DRAINAGE TUBE

[75] Inventor: Anthony E. Flecknoe-Brown, Melbourne, Australia

[73] Assignee: A.A.R.C. (Management) Pty. Limited, Victoria, Australia

[21] Appl. No.: 704,575

[22] Filed: Feb. 22, 1985

Related U.S. Application Data

[63] Continuation-in-part of Ser. No. 419,752, Sep. 20, 1982, abandoned.

[51] Int. Cl.[4] ..... E02B 11/00

[52] U.S. Cl. ..... 405/45; 210/170; 405/43; 405/50

[58] Field of Search ..... 405/36, 43, 45, 48, 405/49, 50; 52/169.5

[56] References Cited

U.S. PATENT DOCUMENTS

| | | | |
|---|---|---|---|
| 3,525,663 | 8/1970 | Hale | 405/36 |
| 3,563,038 | 2/1971 | Healy et al. | 405/45 |
| 3,654,765 | 4/1972 | Healy et al. | 405/45 |
| 3,963,813 | 6/1976 | Keith | 264/167 |
| 4,057,500 | 11/1977 | Wager | 405/43 |
| 4,061,272 | 12/1977 | Winston | 405/45 |

FOREIGN PATENT DOCUMENTS

| | | | |
|---|---|---|---|
| 481017 | 2/1977 | Australia . | |
| 2328800 | 5/1977 | France . | |
| 2462518 | 8/1979 | France . | |
| 56-9515 | 1/1981 | Japan . | |
| 2056236 | 8/1979 | United Kingdom . | |
| 2040655 | 4/1980 | United Kingdom | 405/50 |

*Primary Examiner*—Cornelius J. Husar
*Assistant Examiner*—Kristina I. Hall
*Attorney, Agent, or Firm*—Birch, Stewart, Kolasch & Birch

[57] ABSTRACT

Subsoil drain strip or sheet elements comprising a core surrounded by a polymer or glass fibre filter cloth. The core has a generally planar configuration with hollow formed-in flat topped projections on one or both sides which create internal volume for flow of water as well as supporting the filter cloth against imposed soil loads. The depth of the supporting projections on each side of the core and their relative spacing is to be such that the surrounding filter cloth is restrained against being forced into the hollow interiors of the projections so that adequate longitudinal flow of water can take place in the strip without the need for additional drainage tubes to be provided. The depth of the projections may be greater than one quarter of their closest spacing. Additionally, the average diameter of the projections may be between 0.2 and 0.35 of their closest spacing.

11 Claims, 7 Drawing Figures

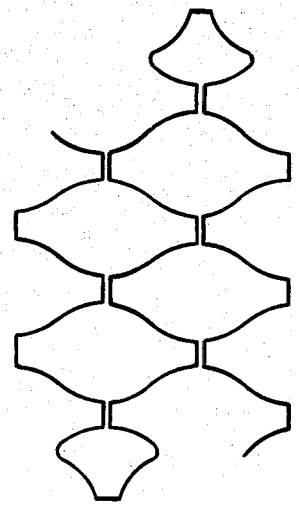
Fig.2(b).
Fig.3.
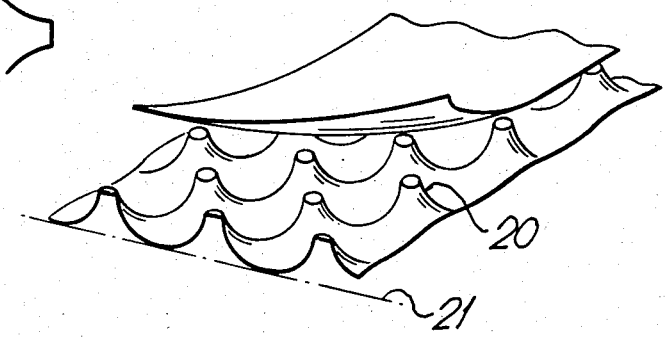
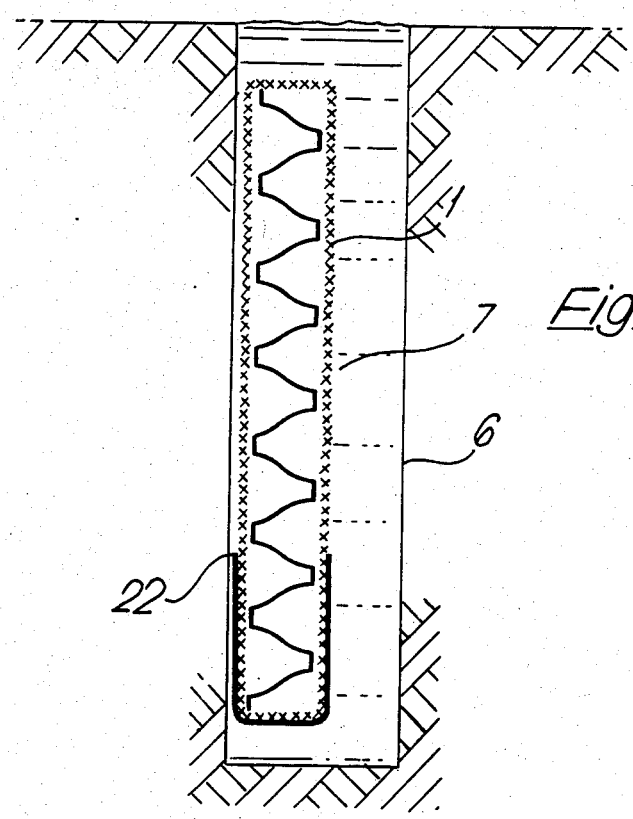
Fig.4.

DRAINAGE TUBE

This is a continuation-in-part of copending application Ser. No. 419,752, filed Sept. 20, 1982, now abandoned.

This invention relates to subsoil in-trench drain systems for use in removing water from soil in agriculture, road building and construction, and in distributing waste water into drainage, irrigation or leach fields.

In agriculture, improved crop yields and prevention of soil salt build-up are obtained by installing subsoil drainage systems traditionally utilizing trenches, filter media such as sand, water transport media such as porous drainage pipe and water gathering media such as gravel.

The installation of such systems is costly and time consuming and can presently only be justified in intensive farming situations yielding high value crops.

Road and highway paving damage is frequently caused by surface water penetrating to the road subbase causing a decrease in the strength of the soil and piping or washing out of the road bed under the paving joints. In addition, freezing of the road bed causes expansion of the bed under the road surface, leading to reflective cracking and spalling.

In construction, hydraulic pressure due to ground water and weakening of the foundation soil due to washing out or piping of the soil fines can cause early damage to structures. Sub-ground basement flooding and rising dampness are caused by inability to remove penetrating water quickly enough.

A number of prior art systems exist to remove water penetrating a soil mass or to lower the existing ground water table. These systems traditionally include the use of sand and mineral aggregates to filter the soil from the water and to allow it to drain in combination with porous or perforated tubes to collect and lead water away. These systems usually clog after a period of time due to the passage and deposition of fine soil particles into the filter and transport media or into the tube slots or the tube itself, even when the system is carefully designed with the particle size distribution of filter media and aggregate media properly matching the native soil in the region to be drained.

In more recent times, permeable plastic polymer or glass fibre filter cloths generally called "geotextiles" have been developed which can be carefully matched in permeability to native soil characteristics and which can relatively permanently separate the native soils from the coarse aggregate used to conduct the water. Both plastic polymer and fiberglass materials are used for geotextiles. The range of cloth manufacturing techniques used includes weaving, spun bonding and melding. These provide geotextile fabrics with a wide range of properties.

Generally, geotextiles are required to be non-corrodible, rot proof and free from the long term disintegrative effects of water and water borne soil chemicals.

They are also required to have high tensile and burst strengths and have a range of water permeabilities which enable them to be matched to a wide range of native soils to provide for proper long term filtration with freedom from blocking or clogging by fine soil particles.

We refer further to a text by P. R. Rankilor entitled "Membranes in Ground Engineering" (John Wiley & Co., New York, N.Y., 1978) which fully details the technical requirements of that class of textiles defined in common use as "Geotextiles" and which discusses the drainage systems which have been developed especially for use with them.

All current drainage systems utilizing Geotextile wraps over gravel cores still require careful design and troublesome and labour intensive installation procedures and there is a need for prefabricated systems which can simplify and improve the use of geotextiles in the field. For example, it is often desired to provide drainage behind near-vertical walls. In such cases the gravel water transport medium is very difficult to deposit because it tends to slump down. Even in geotextile filter-lined trenches wherein placement of the gravel is easier, the gravel is heavy and expensive to transport, requires labour to grade and place and requires removal from the site, of the native soil it replaces.

Porous drainage tubes which constitute one form of prefabricated drainage systems are often now made of plastic polymer and are frequently protected by filter cloths. These however, give limited water access due to their size and shape, are subject to silting up, provide only very localized water collection, are easily crushed or accidentally disconnected, require special fittings for joints and intersections, require proper grading to maintain flow, and need careful bedding-in. When draining layered strata clay soils, such geotextile fabric covered pipes still require the installation of gravel in the trench above them, in order that they may intercept the water carrying strata.

In order to overcome the above limitations and hence, to reduce costs for installation of drainage systems, a number of prior art prefabricated systems have been developed which utilize vertical fins comprising open plastic core surrounded by polymer filter fabric to intercept and channel the subground water into drainage pipes.

Such systems as described by Healy and Long in U.S. Pat. Nos. 3,563,038 and 3,654,765 (herein incorporated by reference) offer substantially more reliable drainage systems, but are hampered by the need for careful installation and labour intensive on-site assembly of the drainage fins and the tubing into continuous lengths. The drainage tube they necessarily incorporate is an additional cost component, because the filter cloth covered fins themselves do not provide enough in-built flow capacity when subjected to lateral soil pressure, to conduct water away from the site quickly, without the provisions of the additional pipe or conduit.

Hence, the use of such systems has been restricted to specialized drainage situations where higher on-site installed costs can be tolerated. In addition, such systems do not incorporate impermeable membranes when waterproofing of a sub-ground wall or road base is required.

Yet other flat laminated geotextile/plastic core drainage systems, as marketed in Europe and U.K. by Imperial Chemical Industries under the trademark "Filtram" comprise separation of the geotextile fabric surfaces by a laterally connective spacer such as extruded plastic net. Such systems may offer proper soil filtration with a very high ratio of water access, however the internal net spacer provides little internal volume because of its shallow structure. The edges of such a product are not usually clad by filter cloth, hence, soil can enter the system, further reducing its effectiveness. Filter fabric over net must be bonded to the net because a loose face fabric could be easily pressed into the net closing off flow. Also, because of adhesive lamination the bonded composite is stiff and inflexible.

As with the other prior art products discussed, the limited internal volume of this product requires that it drain into a slotted plastics pipe, but sealing such laminar drains into pipes involves complex and cumbersome labour intensive systems involving wrapping the slotted pipe in filter fabric and clamping it by means of bars and pegs.

In the system described by Glasser and Lede U.K. Pat. No. 2,056,236, some of the above limitations of the 'Filtram' system have been removed by the use of an impermeable core in which hollow projections and hollows have been formed which support a geotextile surfacing material. The height of the projections and the depth of hollows is not sufficient to provide adequate internal flow to remove the need for an additional drainage tube. In addition, due to inadequate height of the hollow projections in the core form, it is required that the textile be bonded to the shallow core form to facilitate installation and to suspend the cloth against deflection into and subsequently blocking of the core as soil pressure is applied.

Core products are known to the inventor which have provided for the use of a flat sheet on which vertical projections have been formed. For example, in U.S. Pat. No. 4,057,500 to Wager there are proposed continuous solid plastic mouldings which consist of a flat surface on which raised pegs of two heights have been moulded at regular intervals on one or both sides. When wrapped with filter cloth, these systems suffer from not being able to be bent flexibly on a tight radius and they are not able to be joined without the need for special fittings. Such cores also require much more plastic material in their construction than the system of our invention, when subjected to soil pressure the deflecting filter cloth surface is to be supported by the lower height pegs.

Alternative core materials such as those proposed by Hale in U.S. Pat. No. 3,525,663 and Keith in Australian Pat. No. 481,017 provide lighter, more flexible materials which might be utilized in drainage products. However neither of these materials demonstrate a reasonable combination of properties for use in a sub-ground drain as described in the present invention.

Thus, it has now been found that the amount of thermoplastic polymer material to be used in a subsoil drain may be minimized, while the core is able to sustain the necessary loadings imposed on it. It has also been found that the collection ability of a drain will be a more important factor in its design than its flow capacity and that the drainage elements of the invention may be installed to provide increased collection ability with reduced costs over the prior art materials.

SUMMARY OF THE INVENTION

Accordingly the present invention provides an essentially continuous subsoil strip or sheet drainage element comprising an internal supporting formed thermoplastic core strip or sheet of generally planar configuration upon which is disposed on at least one side of the base plane, regularly spaced, hollow, equal depth tapered supporting projections having generally flat tops, said core covered on all four sides with a flexible geotextile filter cloth which is not attached to the projections on the core and is free to move with respect to said projections, the relative depth and spacing of said projections being such as to restrain said filter cloth against being forced into the hollow interiors of the projections.

The depth of the projections is preferably greater than one quarter of their closest spacing and the average diameter of their flat tops may be greater than 0.2 and less than 0.35 of their closest spacing.

Preferably the depth of the hollow tapered projections on one side of the base plane is greater than one-half of said closest spacing between the tops of the projections so that the assembled product can be tightly folded upon itself longitudinally or transversely without damage or significant loss of water carrying capacity.

The supporting projections may occur on both sides of the base plane of the thermoplastic core and be spaced from one-quarter to four inches apart.

The present invention also provides a subsoil drain system in which the drainage element of the invention is installed into a narrow but deep slit trench with said element installed on its edge with the base plane of the element in a substantially vertical plane, with no additional drainage tube or member provided.

The invention provides for an internal supporting spacer or core covered or surrounded by a geotextile filter cloth. The core is open for flow, and has a configuration which enables it to be tightly bent or folded without damage. Such a spacer of our invention takes the general form of a flat sheet optionally perforated, on which projections have been formed on one or preferably both sides.

The projections must be spaced at regular close intervals, typically from one half inch to 4 inches in order to prevent flow reduction when the filter cloth is deflected due to soil pressure. For this reason and for considerations of overall flow capacity, the length of each projection must be at least one quarter of the dimension of the spacing between said projections.

The design of the core and its supporting projections is an important part of this invention. We require that the projections preferably extend from a generally planar sheet as a tapered hollow form with a generally flat top. The method and material of manufacture of such core material is not narrowly critical provided it is not corrodible, is flexible, and is not affected by water. Typically, a plastic polymer material might be chosen, such as unplasticized polyvinyl chloride, polystyrene, polyester or polyolefines such as polyethylene and polypropylene.

The projections are also to be spaced on a uniform grid pattern and these features in combination enable simple but strong joints to be made by overlapping adjacent pieces of core material so the projections nest into each other before replacing the filter cloth back over the join.

The method of assembly of the filter cloth cover over the core is not narrowly critical, it may be wrapped convolutely or helically around the core strip and seamed either with stitching or by means of a glue bead. The material of construction and design of the filter cloth is also not narrowly critical, provided it is of the general category of fabrics known as geotextiles, which have been developed to have adequate strength, durability and filter performance to be incorporated into subground drainage systems.

The filter cloth is not to be bonded or otherwise attached to the core as this causes the drain strip to become rigid and board-like, and reduces its flexibility for bending very substantially.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2*a* and 2*b* show how the drain strip can be folded upon itself in either the longitudinal or transverse direction FIG. 3 shows a single sided core alternative FIG. 4 is a transverse cross section showing how the strip is installed into an in-ground trench

DETAILED DESCRIPTION OF THE PREFERRED EMBODIMENTS

In order to better describe the invention and to show its preferred embodiments, we refer again to the diagrams.

Figure 1:
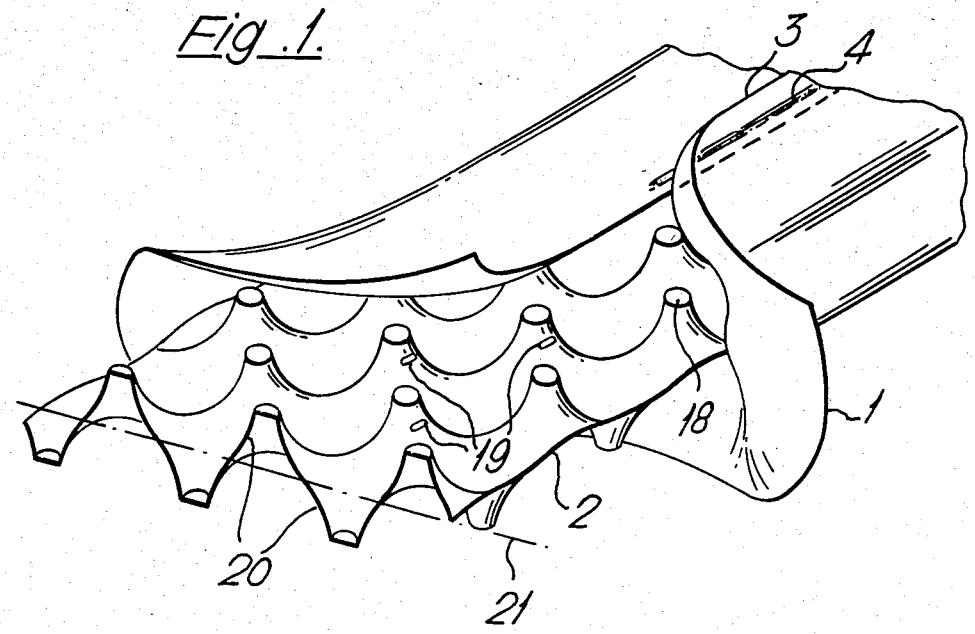
FIG. 1 shows a perspective view of the drain strip

FIG. 1 shows the assembled drainage strip of our invention, consisting of a filter cloth cover (1) wrapped around a flexible supporting core (2) with formed-in projections (20) having generally flat tops (18) optionally perforated with holes (19) with cover (1) being seamed at (3) by a bead of adhesive (4). The cloth cover is not bonded or otherwise attached to the flat tops (18) of the core projections (20) regularly disposed on each side of the central plane (21).

The core 2 of FIG. 1 is a preferred embodiment, and is preferably made by the cuspation process as disclosed in U.S. Pat. No. 3,963,813 which we herein incorporate by reference. Other core configurations or production methods, such as that disclosed in French Pat. No. 2,462,518 do not enable the achievement of sufficient length in the supporting projections to enable adequate internal water flow in the strip without the provision of additional tubes.

Figure 2A:
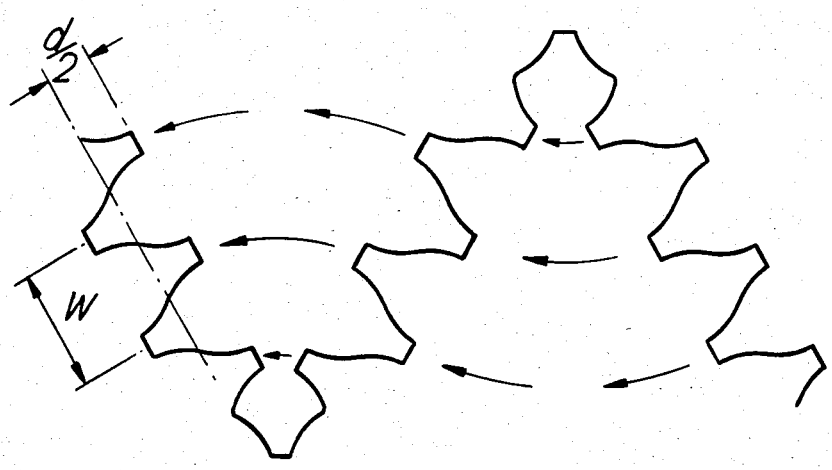

FIG. 2(*a*) shows a core of wavelength w and depth of projection $\frac{1}{2}$ d. For adequate internal drainage we require that d is to be greater than $\frac{1}{2}$ w and preferably that d=w. FIG. 2(*b*) shows how such a core can be folded tightly upon itself without damage. This is also a necessary requirement of our invention if flexibility of installation is to be maintained without substantial flow impairment.

FIG. 3 shows a configuration of core wherein the projections (20) protrude only on one side of the plane (21). This core is less preferred because it will generally require more material in its construction for the internal volume gained, at a given core crush strength.

FIG. 4 shows a transverse cross section of an installation of the drain strip for draining soil. In FIG. 4 the drain strip (1) is placed vertically against the side wall (6) of a narrow slit trench. The originally excavated soil (7) is then replaced as fill in the trench. The deep drain strip intercepts all of the water in any strata which it intercepts, and is especially useful for draining stratified soils. The lower section of the drain strip is optionally covered by an impermeable membrane (22) which prevents transported water from soaking back out of the strip. The deep fin configuration of the drain strip of FIG. 4 has the additional advantage that even if the strip is laid into a level ungraded trench bed, the deep narrow drain strip ensures that the water in it can still flow due to the hydraulic head existing in the depth of the strip itself.

Figure 5:
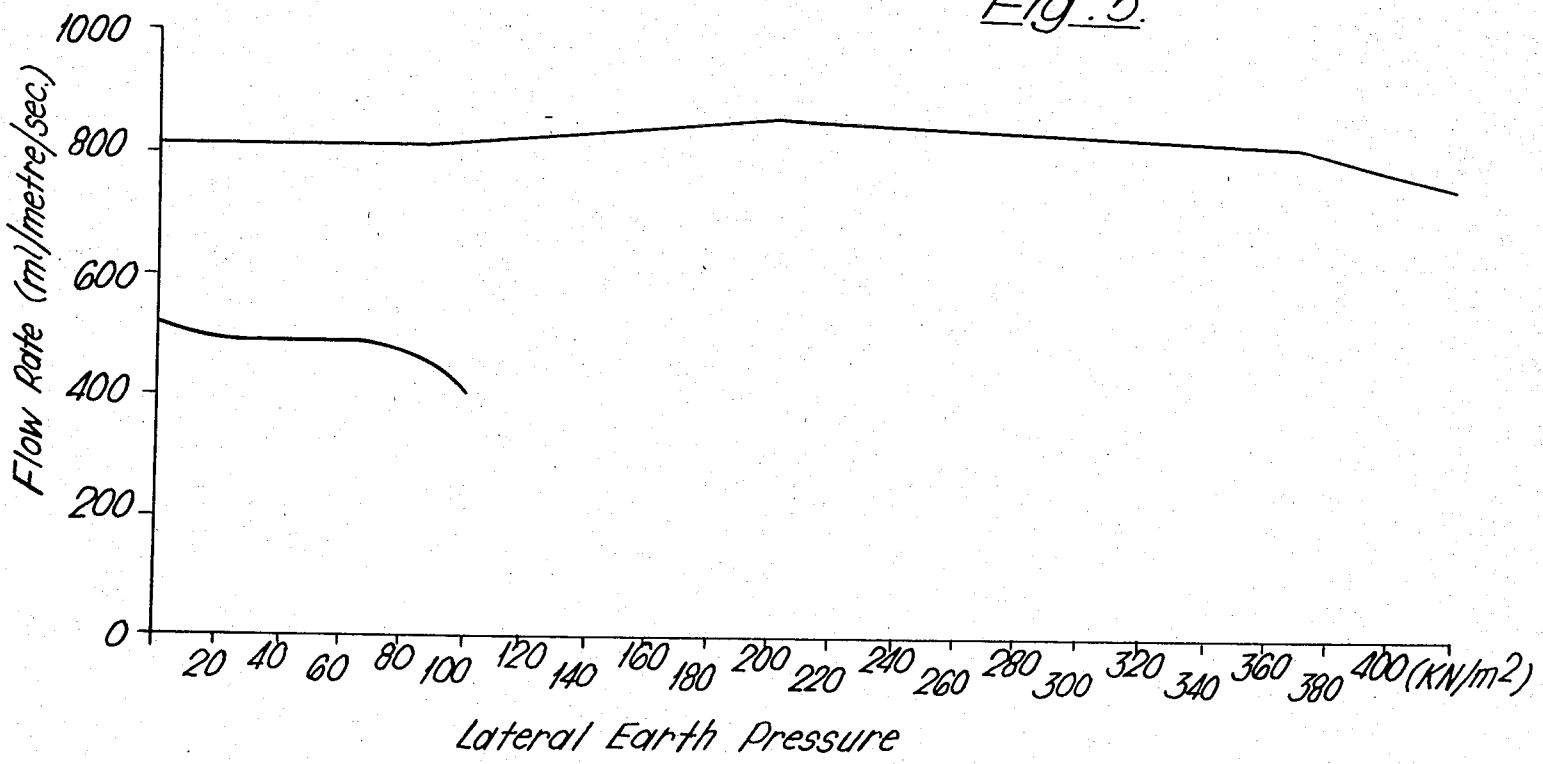
FIG. 5 is a graphical plot of results for flow within the drain strip core as soil pressure is applied.

FIG. 5 shows in the upper line how the geotextile wrapped core of one of our preferred configurations performs for flow as soil load is increased. The preferred configuration material has a 0.5 mm high impact polystyrene core at 12 mm depth of draw. A comparison is made (lower line) with "Filtram", a product comprising extruded plastic mesh bond-laminated with geotextile. The Filtram product begins to fail at soil pressures greater than about 10 psi due to the textile deflecting into and closing off the net core. The core material of our drain configuration sustains unimpeded flow at pressures up to 370 $KN/m^2$ (The apparent rise and fall in flow rate is within the limits of experimental error). Flow impedance in our system only occurs when the core itself begins to collapse due to compression failure, rather than being due to any deflection of the geotextile under soil pressure. The core of our invention comprises projections which are relatively high enough in relation to the spacing, to ensure that the deflected textile surfacing cannot close off the flow, and that the flow itself is substantially higher due to the higher degree of open space which is maintained.

The preferred core for the present pre-fabricated geotextile drainage systems requires considerations of:

COMPRESSIVE CRUSH STRENGTH

This is dependent upon the material thickness, the material distribution in the forming, the material type and the spacing, shape and height of the projections. U.S. Pat. No. 3,963,813 gives an exhaustive treatment of the crush strength of cuspated sheet in relation to polymer, pattern and wavelength. In general, we prefer to use cuspated sheet cores which have compressive crush strengths lying between 10 psi and 80 psi. Cuspated sheet cores have uniquely good properties of compressive strength in relationship to the weight of material in them.

SURFACE AREA SUPPORTING THE TEXTILE

This depends on the size of the generally flat top of the truncated cusp shape and the spacing of the cusps. In coarse patterns of core with say 50 millimeter cusp spacing, relatively large flats are required on the cusps, typically from 10 to 17.5 mm in diameter.

To demonstrate further the advantages of the drainage elements of the present invention, a comparison was made with cores of two closely related prior art materials.

The three alternative cores to be analyzed are the core of Hale (U.S. Pat. No. 3,525,663), the core of Keith (AU 481,017), and the cores preferred for use in the drain of our invention (Flecknoe-Brown). These cores are all formed from flat sheet thermoplastic material, and all consist of regular arrays of hollow projections disposed on each side of a central plane.

(i) Shape

HALE

Large opposed flat tops of diameters greater than half of the closest spacing of the projections on one side of the sheet. Most of the cross sectional area is impeded by the projections.

KEITH

Sharp pointed or small diameter flat tops (if heat flattened). The cross-sectional area is impeded to a much lesser degree by the projections which are, however, too small to properly support an unconnected outer filter cloth layer against soil pressure without penetrating through it.

FLECKNOE-BROWN

Projections having flat tops of diameters between 0.2 and 0.35 of their closest spacing on 1 side of the sheet. The size of the flat projection is sufficient to support the cloth without excessive impedance of the cross-section of the drain by the size of the projection.

(ii) Crush Strength to Core Weight

Three core samples were made on a hydraulic press, under identical forming conditions from identically heated A.B.S. sheet material, according to the three geometric configurations outlined in (i) above. The starting thickness of the sheet, prior to stretching into the respective core shape, was 0.7 mm in each case.

The dimensions of each core and the resulting distribution of material thicknesses in each after stretching to shape, and the measured crush strengths, are detailed below.

(i) Core of Hale

| | |
|---|---|
| Peak separation | = 38.9 mm |
| Thickness of peak top wall | = 0.54 mm |
| Peak diameter | = 19.0 mm |
| Max. Crush Load | = 1670 Newton |
| Sample Size | = $29.5 \times 13.5\ cm^2 = .0398\ m^2$ |
| Max. Crush Pressure | $= \frac{1670\ N}{.0398\ m^2}$ |
| | $= 4.20 \times 10^4\ N/m^2$ |
| | = 6.09 p.s.i. |
| Minimum Side Wall thickness of Projections | = .17 mm |
| Maximum Side Wall thickness of Projections | = .23 mm |
| Average Side Wall thickness of Projections | = .20 mm |
| Weight of sample sheet | = 31.6 g |
| Weight per area of sheet in Test | $= \frac{31.6\ g}{29.5 \times 13.5\ cm^2} \times 10{,}000\ \frac{cm^2}{m^2}$ |
| (To be matched by other materials) | = $793\ g/m^2$ |
| Max. Crush Pressure to Unit Weight | $= \frac{4.20 \times 104\ N/m^2}{793\ g/m^2}$ |
| | = 53.0 N/g |

(ii) Core of Keith

| | |
|---|---|
| Peak separation | = 35.3 mm |
| Thickness of peak top wall | = 0.65 mm |
| Peak diameter | = 5.0 mm |
| Max. Crush Load (Sample A = $815\ g/m^2$) | = 4545 N |
| Sample Size | = $15.5 \times 33.0\ cm^2 = .0512\ m^2$ |
| Max. Crush Pressure | $= \frac{4545\ N}{.0512\ m^2}$ |
| | $= 8.88 \times 10^4\ N/m^2$ |
| | = 12.9 p.s.i. |
| Maximum Crush Pressure to unit weight | $= \frac{8.88 \times 104\ N/m^2}{815\ g/m^2}$ |
| | = 109 N/g |
| Minimum Side Wall Thickness of Projections | = .30 mm |
| Maximum Side Wall Thickness of Projections | = .55 mm |
| Average Side Wall Thickness of Projections | = .41 mm |

(iii) Core of Flecknoe-Brown

| | |
|---|---|
| Peak separation | = 35.3 mm |
| Thickness of peak top wall | = 0.58 mm |
| Peak diameter | = 11.0 mm |
| Max. Crush Load (Sample F = $792\ g/m^2$) | = 3100 N |
| Sample Size | = $12.5 \times 30.0\ cm^2 = .057\ m^2$ |
| Max. Crush Pressure | $= \frac{3100\ N}{.0375\ m^2}$ |
| | $= 8.27 \times 10^4\ N/m^2$ |
| | = 12.0 p.s.i. |
| | $= \frac{8.27 \times 104\ N/m^2}{792\ g/m^2} = 104\ N/g$ |
| Minimum Side Wall Thickness of Projections | = .30 mm |
| Maximum Side Wall Thickness of Projections | = .35 mm |
| Average Side Wall Thickness of Projections | = .33 mm |

DISCUSSION OF CRUSH RESULTS

As expected, the large area of the flat tops in the core of Hale, leaves a relatively small area of sheet remaining to be stretched. Hence, the average and minimum wall thickness give rise to the lowest core crush strength for a given weight of core.

The surprising result of these above tests is that the core of Keith, in which the area of the flat tops is very small, and the average wall thickness of the projections is highest, is not significantly stronger in crush to weight (Max. Crush Pressure per unit weight) than the preferred core in the drain of our invention. This is evidently due to the inability of the small diameter projections to "pull" the stretching material into even wall thickness. The projections of Keith's core collapse near the peaks.

The core of Flecknoe-Brown, wherein the core peak diameter lies within the range of 0.2 to 0.35 of the closest spacing of the projections (as measured on one side of the central plane) provides adequate cloth support and has the most uniform wall thickness core together with the minimum weight of drains for a given crush strength.

The foregoing demonstrates two unexpected and unique properties of the drain of our invention, when such is utilized for the horizontal drainage of land:

the shape of the drain of our invention together with its method of installation, leads to superior performance over all other types of drain.

support of the surface filter cloth by the core projections of the drain is adequate to prevent damage to the cloth under compressive soil loadings.

the weight of drain is minimized, for a given crush strength.

Yet other configurations of the drain strip of our invention will be perceived by those skilled in the art. For example, wide strips of heavy cored product could be laid side by side, transversely across or longitudinally along the soil under a road or railway bed to provide a separation and drainage layer strong enough to resist crushing due to the combined soil and traffic loads.

The following table gives an approximate comparison of the amount of plastic polymer (and hence cost) saved by the drain of the invention when compared with filter cloth covered tubes.

The dramatic performance improvement exhibited by the land drains of the invention over those existing are thus shown to lead to a more economic drain which should find wide acceptance in land and road edge drainage.

COMPARISON OF 40 MM THICK DRAIN STRIP WITH STANDARD TUBE DRAINS OF EQUAL WATER TABLE DRAWN DOWN PERFORMANCE

| Strip Width (mm) | Equipalent Convoluted Tube Diameter | Typical Weight of Polymer in Tubes (Gm. per meter) | Weight of Polymer in Drain Strip Core (Gm. per meter) | Savings in Polymer (Gm. Per meter) |
|---|---|---|---|---|
| 100 | 100 | 350 | 65 | 285 |
| 200 | 150 | 550 | 130 | 420 |

The savings in plastic material in the above compared drain results because less polymer needs to be used for adequate crush strength in a vertical core of our configuration than is required to support a circular tube type drain against imposed soil loads or superimposed loads due to surface traffic.

The foregoing discussion has emphasised the importance of the weight of core per meter, and of the flow capacity of the formed drain, as design criteria for any subground drainage system. Water collection performance has been found to be of major importance and this performance is largely dependent on the geometry of the drain.

Seepage normally flows parallel to the surface of the land, roughly horizontally. The rate of seepage in soils is generally very low. For example, in most normal soils (other than sand), water permeates at rates typically less than 1 meter per day. In clay soils, this rate may even be less than 1 meter per year.

These seepage rates typically result in a total outflow of less than 10 liters per minute in a drain tube 100 meters long buried 1 meter down. Hence normal corrugated drain tubes have many times greater flow capacity than is needed for most installations; such tubes are as large as they are to enable more efficient water collection.

However, while seepage flow at large distances towards a drain can be thought of as having parallel and horizontal flow lines, in the vicinity of a tube drain the flow lines will converge towards the drain. The radial flow in the vicinity of a tube drain reduces the collection rate of the drain which is further limited by the restricted number of apertures in the tube allowing water entry.

In a vertical sided drain, the horizontal flow streamlines do not have to "curve" downwards or upwards towards a tube. As lengthening of the seepage flow paths very markedly affects the collection rate of a drain system, the minimal flow path lengths achieved with vertical sided drains make these types of drain more efficient collectors. The drainage elements of the invention are particularly suited to present a vertical-sided uniformed porous surface to the soil.

Figure 6:
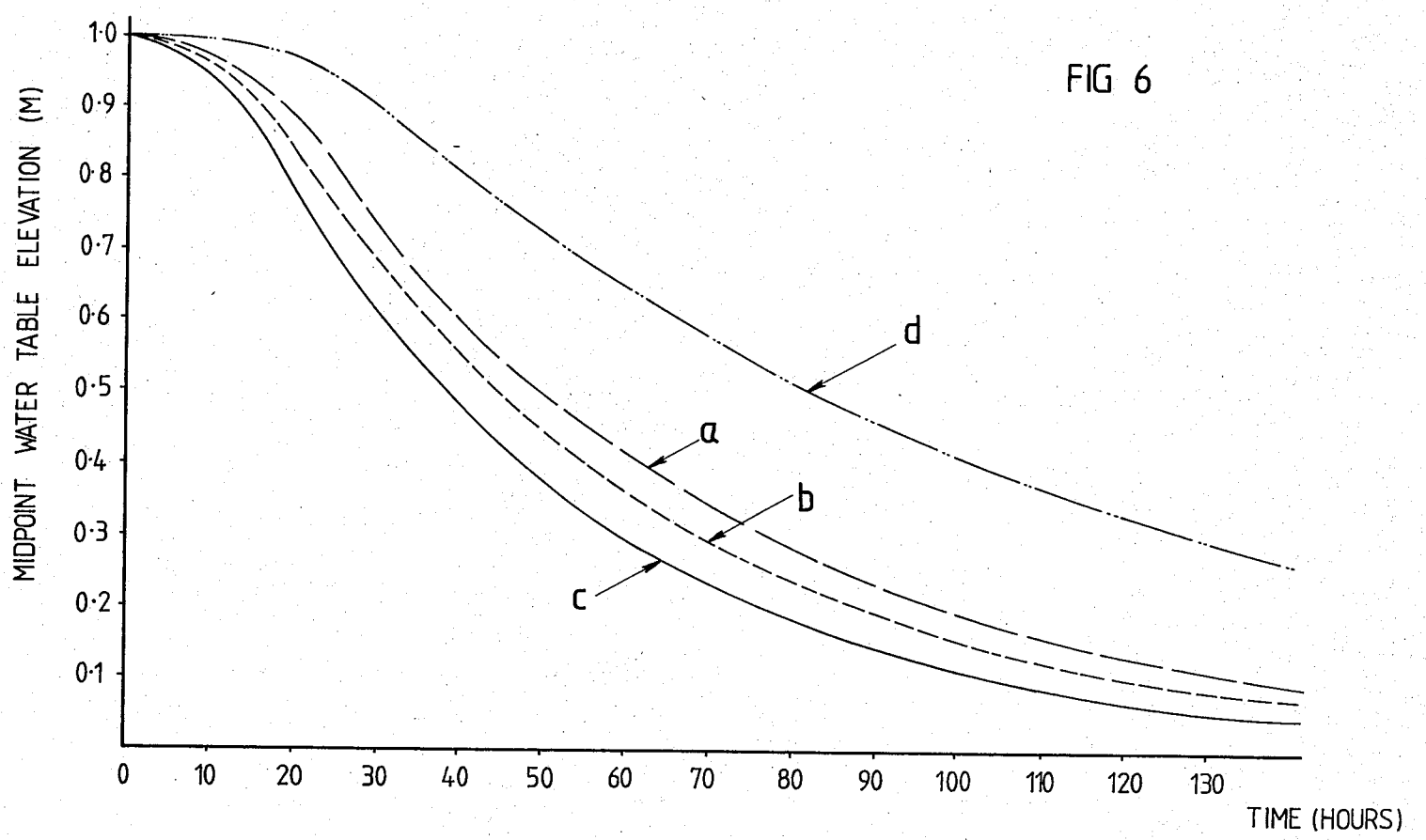
FIG. 6 is a graph in which the heights of the water table at the midpoint between two subsoil drains are plotted against time for various drains.

Despite the foregoing, conventional and commercial wisdom has promoted the use of perforated drain tubes, preferably encased in a filter sock or laid in an aggregate filled trench. FIG. 6 illustrates the results of comparisons between drains made according to the invention and perforated tube drains. In the figure, the heights of the water table at the midpoint between two subsoil drains are plotted against time for various drains. The water table is initially considered to be horizontal (at time=0) at a certain height above the drains, as might be the case after a deluge or irrigation.

In FIG. 6, the letters b and c relate to drains made according to the invention both having strip widths of 40 mm and vertical strip heights of 100 and 200 mm respectively. Letter d relates to a perforated tube drain of 100 mm diameter without a filter sock and laid directly in soil. Letter a relates to a perforated tube drain with a filter sock and having 100 mm diameter.

A perforated tube drain without a filter sock clearly draws the watertable down at the slowest rate since it has the smallest draining surface. It will be noted further that while covering the tube drains with filter cloth does substantially increase their drawdown capabilities, they are still not quite as good as the drains of the invention of similar height to the diameter of circular drain tubes.

The criteria for the design of a drainage system are usually either that the water table should never be allowed above a certain depth below the surface, or that the water table should be drawn down by a certain amount in a specified time. In both cases, the better drainage geometry and functioning of drains of the invention will mean that either the drains can be spaced further apart or that they can be placed in shallower trenches than tube drains. The consequent potential savings in costs in either event will be apparent.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Having now described my invention, what I describe as new and desire to secure and claim by Letters Patent is:

1. An essentially continuous subsoil sheet drainage element comprising:

a core sheet of generally planar configuration having on at least one side of a plane regularly spaced, hollow, equal depth supporting projections each having a base and a flat top, said plane located at the base of each projection; and a covering of geotextile filter cloth surrounding said core;

the depth of projections on one side of said plane and the spacing between adjacent projections permits the core sheet to be tightly folded upon itself without damage or significant loss of water carrying capacity.

2. The essentially continuous subsoil sheet drainage element according to claim 1, in which said supporting projections having a depth on one side of said plane greater than one-quarter of the distance measured center to center of adjacent projections.

3. The essentially continuous subsoil sheet drainage element according to claim 1, said supporting projections having flat tops of average diameter greater than 0.2 and less than 0.35 of the closest distance measured from center to center of adjacent supporting projections.

4. The essentially continuous subsoil sheet drainage element according to claim 2, said supporting projections having flat tops of average diameter greater than 0.2 and less than 0.35 of the closest distance measured from center to center of adjacent supporting projections.

5. The essentially continuous subsoil sheet drainage element according to claim 1, in which said supporting projections having a depth of one side of said plane equal to one-half of the distance measured center to center of adjacent projections.

6. The essentially continuous subsoil sheet drainage element according to claim 1, in which said supporting projections occur on both sides of the plane of said core and are spaced from one-half to four inches apart.

7. The essentially continuous subsoil sheet drainage element according to claim 1, in which the essentially continuous subsoil sheet drainage element having one longitudinally extending continuous edge surfaced with impermeable waterproof material.

8. The essentially continuous subsoil sheet drainage element according to claim 1 in which the essentially continuous subsoil sheet drainage element having one longitudinally extending continuous edge, said supporting projections are disposed on both sides of the plane of said core, are spaced from one-half to four inches apart center to center, and have a depth greater than one-half the distance between adjacent supporting projections, and wherein a portion of said filter cloth covering and adjacent said one longitudinally extending continuous edge is surfaced with impermeable waterproof material.

9. An essentially continuous subsoil sheet drainage element comprising:

a core sheet of generally planar configuration having on at least one side of a plane regularly spaced, hollow, equal depth supporting projections each having a base and a flat top, said plane located at the base of each projection;

said supporting projection having a depth on one side of said plane greater than one-quarter of the distance measured center to center of adjacent projections;

a covering of geotextile filter cloth surrounding said core;

the essentially continuous subsoil sheet drainage element having one longitudinally extending continuous edge surfaced with impermeable waterproof material.

10. A subsoil drainage system comprising:

a narrow deep slit trench in which is installed an essentially continuous subsoil sheet drainage element comprising:

a core sheet of generally planar configuration having on at least one side of a plane regularly spaced, hollow, equal depth supporting projections each having a base and a flat top, said plane located at the base of each projection;

a covering of geotextile filter cloth surrounding said core;

the depth of projections on one side of the base plane and the spacing between adjacent projections permits the core sheet to be tightly folded upon itself without damage or significant loss of water carrying capacity.

11. A subsoil sheet drainage element of indeterminate length comprising:

a core having a longitudinal and transverse dimension;

a first plurality of regularly spaced, hollow, equal depth supporting projections being disposed on at least one side of said core sheet and arranged in a first row, each supporting projection having a base portion and a flat top;

a second plurality of regularly spaced, hollow, equal depth supporting projections being disposed on said at least one side of said core sheet and arranged in a second row each supporting projection having a base portion and a flat top;

a third plurality of regularly spaced, hollow, equal depth supporting projections being disposed on said at least one side of said core sheet and arranged in a third row each supporting projection having a base portion and a flat top;

said second plurality of supporting projections being staggered relative to said first and second rows of supporting projections wherein the flat tops are spaced equidistant relative to each other;

said first, second and third rows of supporting projections being repeated along the longitudinal and transverse dimension of said core sheet;

a geotextile filter cloth surrounding said core sheet;

a hinge being formed by at least one of said first, second and third rows wherein folding the core sheet aligns adjacent flat tops of displaced rows to space said base portions apart for forming a plurality of passageways between said first, second and third rows.

* * * * *

UNITED STATES PATENT AND TRADEMARK OFFICE

CERTIFICATE OF CORRECTION

PATENT NO. : 4,639,165

DATED : January 27, 1987

INVENTOR(S) : Anthony E. Flecknoe-Brown

It is certified that error appears in the above-identified patent and that said Letters Patent is hereby corrected as shown below:

COVER PAGE

Add --[30] Foreign Application Priority Data

September 25, 1981 [AU] Australia ...PF 0932 [U]--

Change "Date of Patent: January 27, 1986" to

--Date of Patent: January 27, 1987--.

Signed and Sealed this

Eighth Day of December, 1987

*Attest:*

*Attesting Officer*

DONALD J. QUIGG

*Commissioner of Patents and Trademarks*